US007024706B2

(12) United States Patent
Hess

(10) Patent No.: US 7,024,706 B2
(45) Date of Patent: Apr. 11, 2006

(54) APPARATUS AND METHOD FOR PREVENTING WATER FROM ESCAPING A SHOWER AREA

(75) Inventor: Stephen W. Hess, Apple Valley, CA (US)

(73) Assignee: Fiber Care Baths, Inc., Adelanto, CA (US)

( * ) Notice: Subject to any disclaimer, the term of this patent is extended or adjusted under 35 U.S.C. 154(b) by 0 days.

(21) Appl. No.: 10/172,666

(22) Filed: Jun. 14, 2002

(65) Prior Publication Data

US 2002/0189011 A1 Dec. 19, 2002

Related U.S. Application Data

(60) Provisional application No. 60/298,513, filed on Jun. 15, 2001.

(51) Int. Cl.
*A47K 3/08* (2006.01)

(52) U.S. Cl. ..... 4/557; 4/558; 4/608; 4/609

(58) Field of Classification Search ..... 4/557, 4/558, 608, 609, 610; 248/264, 261; 160/349.1, 160/330; 16/87.4 R; 211/87.01
See application file for complete search history.

(56) References Cited

U.S. PATENT DOCUMENTS

| | | | | |
|---|---|---|---|---|
| 823,259 | A * | 6/1906 | Burns | 160/330 |
| 2,778,030 | A * | 1/1957 | Goche | 4/608 |
| 4,453,280 | A * | 6/1984 | Greenleaf | 4/599 |
| 4,754,504 | A * | 7/1988 | Cellini | 4/610 |
| 5,022,104 | A * | 6/1991 | Miller | 4/558 |
| 5,031,257 | A * | 7/1991 | Jeffery | 4/610 |
| 5,371,908 | A * | 12/1994 | Secondine | 4/609 |
| 5,662,297 | A * | 9/1997 | Christensen et al. | 4/608 |

* cited by examiner

*Primary Examiner*—Khoa D. Huynh
(74) *Attorney, Agent, or Firm*—Myers Dawes Andras & Sherman LLP; Vic Lin

(57) ABSTRACT

A shower curtain rod and holding devices provide for a shower area to be covered on a plurality of sides by an associated shower curtain to prevent shower water from escaping. The shower curtain rod is non-linear and is mounted at distal ends to walls of the shower area at least one-third of a total shower depth from a front of the shower. The holding devices have mounting portions that can be attached to walls in a variety of ways. A method of preventing water from escaping from the shower implements the rod and holding devices. A method of installing the rod and holding devices is easy and requires few steps.

13 Claims, 9 Drawing Sheets

APPARATUS AND METHOD FOR PREVENTING WATER FROM ESCAPING A SHOWER AREA

CROSS REFERENCE TO APPLICATIONS

This is a non-provisional patent application claiming the priority of provisional application Serial No. 60/298,513, filed Jun. 15, 2001, and entitled "Not a drop", which is incorporated herein by reference.

BACKGROUND OF THE INVENTION

1. Field of the Invention

The instant invention relates generally to bathroom accessories, and more specifically to shower curtain rods, mounting devices for installing curtain rods, and methods of installing and using shower curtain rods.

2. Description of Prior Art and Related Information

In protecting a bathroom from the adverse effects of water escaping from a shower area of the bathroom, artisans of the past have developed a variety of conventional shower rods, curtains, and mounting devices. The most common apparatus of the past includes a straight metal rod that is mounted to opposite walls above the shower by flange members that are screwed into the wall. The flange members of the past typically have central openings for receiving and supporting respective ends of the curtain rod. The engagement of shower rods with these flange members allow the rod to rotate easily within the mounting devices. Therefore, the devices of the past are deficient in resisting rotation when a torquing force is applied.

Furthermore, the shower rods are typically straight and are therefore deficient in providing a surrounding effect. Alternatively stated, the most common shower rods of the past do not adequately provide for covering a plurality of sides of a shower area. Rather, the rods of the past typically cover a shower access opening side of the shower area only. Even if a user attempts to extend a portion of a curtain that is supported on the conventional straight rods in a depth direction at the ends of the shower area, the rod does not permit sufficient coverage of additional sides.

Also, the reveal of most tub and shower combinations tends to push the ends of the shower curtain inwardly away from end walls of the shower. Thus, not only is it difficult for a user to get any coverage of the end walls, but it is also difficult to keep the shower access side covered. Hence, at least some water will usually escape from the shower area during showering. Escaping water results in damage to floors, floor coverings, cabinets, and furniture. Furthermore, escaping water requires added clean-up. More importantly, wet floors result in accidents. Hence, the conventional devices of the past are deficient in protecting floors, furniture, and people.

Furthermore, the method of mounting conventional shower curtain rods requires attaching at least one of the mounting devices after inserting the shower curtain rod in the mounting device. This has the disadvantage of being cumbersome and requires physically keeping track of both the rod and the mounting device at the same time. Thus, the shower rod devices of the past are deficient in providing an apparatus that only requires attention to one of the rod and the mounting devices during attachment of the mounting devices to opposite walls.

Other conventional shower rods and mounting devices are rigidly connected to each other, but still lack the non-linear configuration that enables shower curtain coverage of plural surrounding sides. To accomplish the further surrounding configuration, past devices have implemented rods and mounting arrangements that attach at a multitude of locations to surrounding walls and/or the ceiling. The most common form of mounting the shower rods of this type is by additional branches off of the shower rod with the branches mounted to the walls or the ceiling. However, these additional branches interfere with free sliding of the curtain along the entire shower curtain rod. That is, if a branch is provided at a central location along the shower curtain rod, then the shower curtain rings are stopped by the branch and cannot pass. Such branches at corners, for example, would not permit a single shower curtain to be extended around the corner and slid in the depth direction to the rear.

Further examples of past devices include spring loaded or internal screw threaded rods with pads or cleats on opposite distal ends for engaging the end walls. These devices generally depend on friction for mounting to the opposite end walls. Hence, they are not well adapted for withstanding torquing forces and the rods of these devices are straight. Therefore, the rods of the spring loaded and internal screw threaded devices are deficient in the same way as the other straight rods described above.

SUMMARY OF THE INVENTION

The apparatus and method in accordance with the invention overcome the deficiencies of the past and fill a long felt need in the art of shower curtains, rods, and methods of preventing water from escaping a shower area. In particular, a shower rod, holding devices and method of installing and using the apparatus prevent water from escaping between a shower curtain and end walls that at least partially surround a shower. This is accomplished by providing and positioning the shower curtain rod so that it extends not only along the length of the shower area, but also extends in a depth direction along the end walls so that the shower curtain can be pulled rearwardly in a depth direction to overlap large portions of the end walls. In this way, the water is prevented from escaping from the shower area because in order to do so, the water would have to travel a large distance in the forward direction. The depth position to which the curtain is pulled also determines the maximum forward traveling angle at which water from a shower head can engage a rear end edge of the curtain. Hence, even if the reveals tend to separate portions of the curtain away from the end walls, the curtain can be extended rearwardly far enough to prevent any water from escaping between the curtain and the end walls.

A shower curtain rod and a holding device apparatus has several structural and functional features that aid in fulfilling the above stated purpose. The rod has two ends that are distal from each other with the two ends being generally non-collinear with each other. The rod has a middle portion between the two ends that at least partially circumscribes an area that is offset from a longitudinal axis through the ends. The rod has a length measured along the longitudinal axis and a depth measured perpendicularly to the longitudinal axis.

The holding device has at least one receiving portion axially aligned with and supporting at least one of the ends of the rod in a direction transverse to the longitudinal axis. The holding device also has at least one mounting portion with a wall-engaging surface regularly facing in a longitudinal direction for mounting the holding device on a wall that at least partially surrounds a shower. Typically, the holding device will be one of a plurality of holding devices included in the apparatus. The holding devices have respective receiving portions that can be parallel to each other and receive respective opposite ends of the rod.

Even though the shower rod has a depth as well as a length dimension and therefore experiences increased torque at its opposite distal ends from the weight of the curtain it supports, the engagement of the distal ends in the receiving portions of the holding devices prevents rotation of the shower rod. The holding devices and means for mounting are provided in a manner that withstands the additional torque of the nonlinear shower rod. Furthermore, the holding devices are configured to enable easy installation of the shower rod thereon once the holding devices have been mounted. One of the holding devices can withstand the additional torque. Two holding devices are preferred in order to receive and support respective opposite ends of the shower curtain rod. No more than two holding devices should be used in most applications since additional holding devices would necessitate additional branches off of the shower rod that will generally interfere with the otherwise advantageous benefit of enabling nonlinear sliding of the shower curtain over substantially the entire curtain rod from end to end.

In one aspect, the shower curtain rod and holding device apparatus are exemplified by the rod having a middle portion between the two ends, wherein the middle portion generally defines three sides of a polygonal area. On the other hand, it is to be understood that the shower curtain rod can be simply defined as having a middle portion between the two ends that generally provides a plurality of sides of a shower area.

In another aspect, the shower curtain rod can be simply described as a nonlinear rod that has two ends that are distal from each other with the ends defining generally non-collinear axes relative to each other. The holding device can be simply described with the receiving portion having a central axis slidingly receiving at least one of the ends of the rod in an axial direction.

In one configuration, the nonlinear rod has a lengthwise linear central portion and depth-wise portions provided by obtuse bends at each end of the central portion. The depth-wise portions each have an additional 90 degree bend terminating in respective distal ends of the nonlinear rod. In this configuration, the obtuse bends are formed about respective parallel axes of curvature to form the depth portions as mirror images of each other. The additional 90 degree bends are formed about additional axes of curvature that are perpendicular to the respective parallel axes. With the respective parallel axes oriented vertically, it can be seen that the depth members will extend horizontally and the respective distal ends will extend vertically. Advantageously, the distal ends are bent downwardly to easily slip into respective receiving portions of the holding devices during installation.

Another aspect of this configuration is that the first bends are resilient so that respective depth portions can flex inwardly toward each other. This aspect provides the advantage of enabling the rod and holding devices to be accommodated between end walls of the shower that are closer together than the overall length of the rod and the holding devices in their natural unflexed condition. This aspect also has the advantage of providing an outwardly directed mounting force that increases a friction force between the holding devices and the walls to which they are mounted.

The shower curtain rod can be provided as one piece or can be formed of a plurality of pieces. The plurality of pieces can be spliced together to provide the intended configuration including length and depth portions of dimensions to fit particular showers. Alternatively, sections of the portions can be removed and the remaining pieces spliced back together in order to shorten the portions in order to accommodate the apparatus in a particular shower. To this end the apparatus can advantageously include splicing plugs for forming joints in any of the depth and lengthwise portions.

The apparatus and methods include means for accommodating the apparatus in showers of a variety of sizes and configurations. Two such means, which entail adjusting the length of the shower curtain rod, have been summarized above. More details and additional means for accommodating are further described in the Detailed Description below.

The apparatus can be advantageously packaged as a kit. The kit includes the essential elements as set forth above to enable installation of a working apparatus. Advantageously, a variety of kits can be packaged to fit the most standard target sizes of showers. This requires the manufacture of pieces having dimensions that will fit these standard sizes of showers. Then the pieces are grouped according to the particular standard sizes that have been targeted for the kits. Furthermore, the kits will generally advantageously have additional parts that will enable alternative configurations and alternative means for attachment. For example, the kit may include a plurality of splicing plugs for forming spliced joints in the shower rod.

While the apparatus includes the combination of the shower rod and holding devices as set forth above, there are significant advantages individually provided by various sub-combinations of the apparatus including the several variations of shower rods, details of the splicing plugs, and the details of the mounting means.

In accordance with the invention, the method of preventing water from escaping from a shower area comprises sliding an end of a shower curtain on a depth portion of the shower curtain rod. The shower curtain is slid in the depth direction, which is transverse to a plane of an entry opening of the shower. That is, the shower curtain is slid toward a back wall of the shower. One aspect of the method of preventing water from escaping entails sliding the shower curtain at least one-third of a total depth of the shower area to surround a large portion of an end of the shower area. The method includes surrounding the shower area on at least portions of two adjacent sides of the shower area, and preferably on three sides including opposite ends.

The method of installing a shower curtain rod and holding devices in accordance with the invention provides improved shower water isolation and ease of installation. The method includes attaching at least one holding device to a wall that at least partially surrounds the shower. The holding device is attached at a minimum of one-third of a total depth of the shower area from a front of the shower. In practice, two of the holding devices are attached in the same way on opposite end walls of a shower area to provide attachment points that advantageously enable coverage of large portions of the end walls as set forth above. Before installing the shower rod on the holding devices, the curtain is slid onto the curtain rod. Then respective ends of the curtain rod are coupled to the holding devices so that the shower curtain at least partially surrounds the shower area and can selectively be moved to extend at least one third of the total depth from the front of the shower.

One aspect of the method is the step of accommodating the apparatus between the walls having a different dimension than the overall length of the shower curtain rod and the holding devices. This step of accommodating can entail filling a gap between the curtain rod and at least one of the holding devices or filling a gap between at least one of the holding devices and the wall to which the holding device is to be mounted. Alternatively, the step of accommodating can entail shortening the shower curtain rod length to fit in a shower having a shorter length than the overall length of the apparatus. Similarly, the depth of the apparatus can be increased or decreased to match the size and configuration of a particular shower.

In one aspect, the method of installing is a method of retrofitting. That is, the method may include the step of removing and replacing an existing curtain rod by the curtain rod and holding devices in accordance with the instant invention.

The invention, now having been briefly summarized, may be better visualized by turning to the following drawings wherein like elements are referenced by like numerals.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
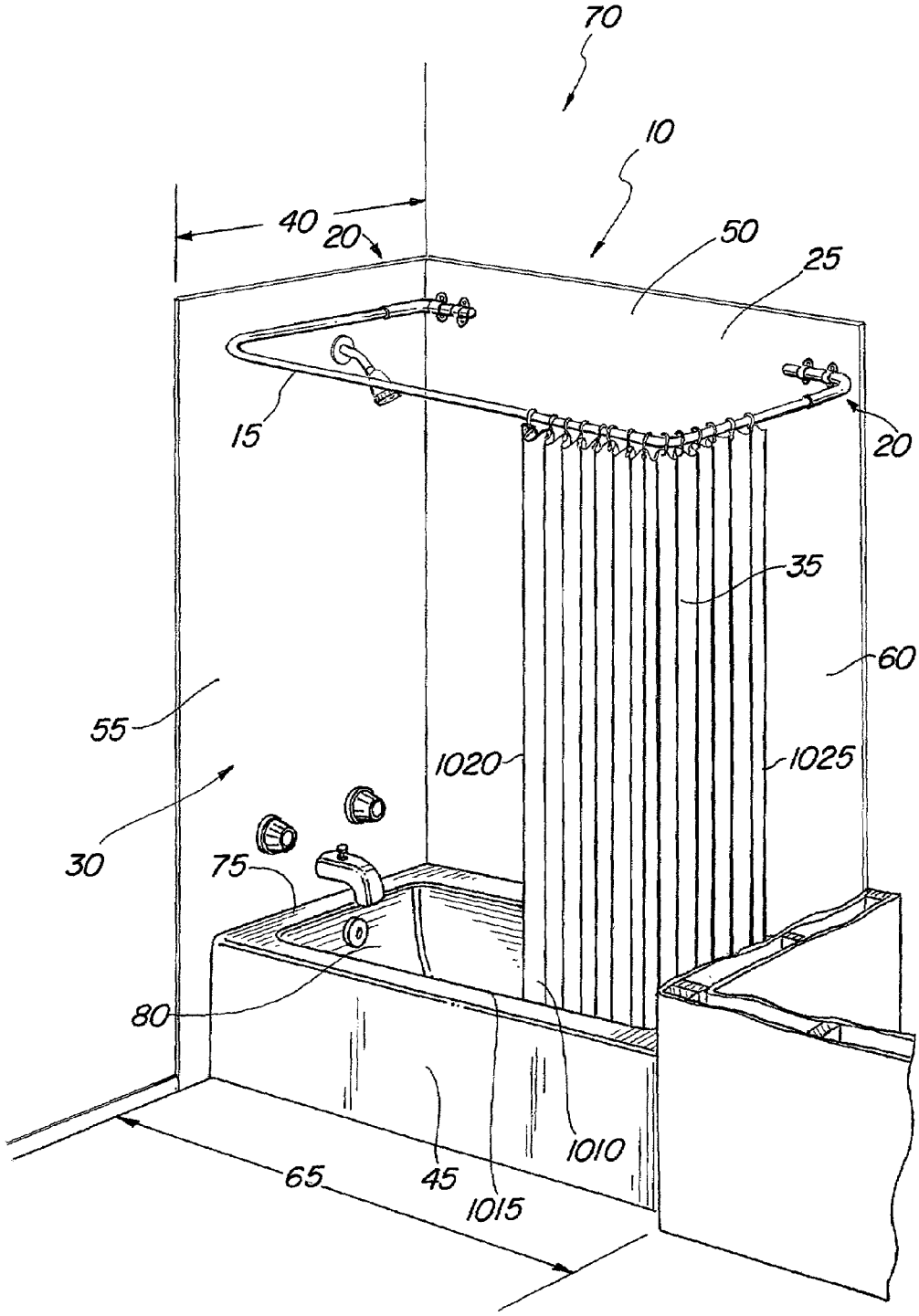
FIG. 1 is a perspective view of a first exemplary embodiment applied to a shower.

An exemplary embodiment 10 of a shower rod assembly is shown in FIG. 1 and has a shower rod 15 and a pair of holding devices 20 mounting the shower rod 15 to a back wall 25 of a shower 30. In accordance with the invention, the shower rod 15 and holding devices 20 enable a shower curtain 35 to extend over and cover large portions of a depth 40 measured from a front 45 to a rear 50 of the shower 30. This covering is implemented both at a wet end 55 nearest the shower head and at a dry end 60 farthest from the shower head of the shower 30, and is in addition to the conventional coverage of a length 65 between the wet end 55 and the dry end 60 of the shower 30. In this way, the shower curtain 35 surrounds a shower area 70 on a plurality of sides and substantially prevents water from escaping between the shower curtain 35 and the shower ends 55, 60.

Of particular consequence with the conventional shower rod and curtain arrangements is the reveal 75 of most tub and shower combinations. The reveal 75 is the horizontal portion of the tub 80, which extends in a direction of the length 65 inwardly from the ends 55, 60, typically in the range of 1 to 3 inches. As such, the reveal 75 tends to separate conventional shower curtains from the ends 55, 60 of the shower 30 and permit water to escape during showering.

Figure 2:
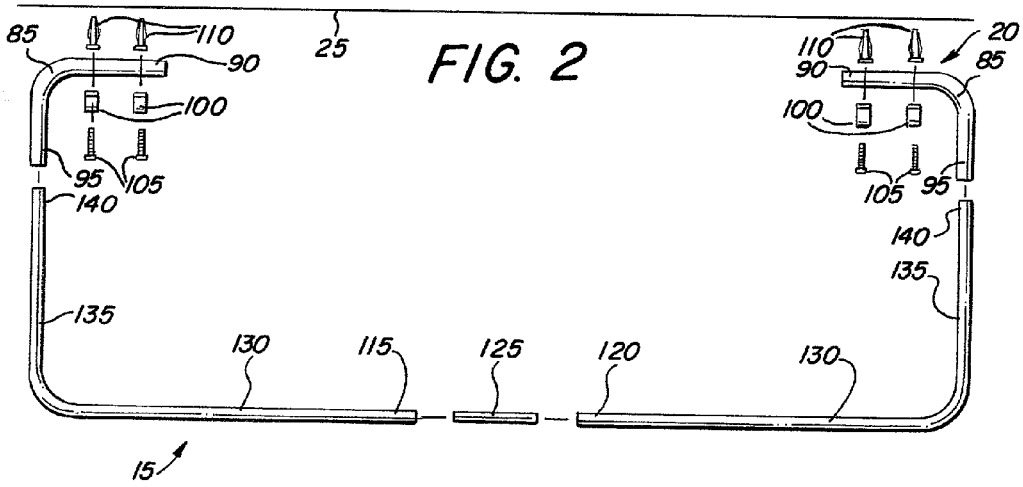
FIG. 2 is an exploded top plan view of an alternative of the first embodiment similar to FIG. 1, but having the rod formed of a plurality of pieces.

The exploded top plan view of FIG. 2 shows further details, which can be implemented with the embodiment of FIG. 1. The holding devices 20 comprise elbow tubes 85, each having a mounting portion 90 and a receiving portion 95. The mounting portions 90 are attached to the back wall 25 with clamps 100 by screws 105. The screws 105 can be of the self-tapping type. Alternatively, expansion receivers 110 can be inserted into the back wall 25 and receive the screws 105 in the form of standard screws. Preferably, the materials for each of the components are non-corrosive and may include plastics, stainless steel, brass, or non-corrosive coatings.

Figure 3:
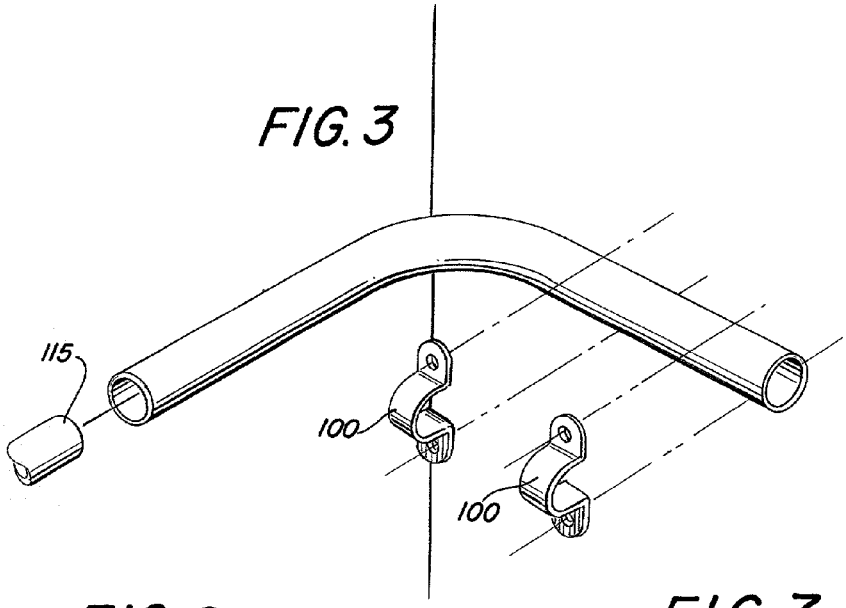
FIG. 3 is an exploded perspective view of the holding device and an end of the rod in accordance with the embodiments of FIGS. 1 and 2.

The shower curtain rod 15 can be made of a plurality of pieces 115, 120 connected together by a splicing plug 125. In the instant embodiment, each of the pieces 115, 120 is identical to the other and includes a length portion 130 and a depth portion 135. In this way, length portions 130 and death portions 135 provide a rod 15 that is non-collinear. When the length portions 130 are assembled together by the splicing plug 125, the shower curtain rod 15 has opposite distal ends 140 for insertion in the receiving portions 95 about a central axis 95*a*, of the respective holding devices 20 as illustrated in FIGS. 2 and 3. Since the plurality of pieces 115, 120 have a tubular structure, the splicing plug 125 in combination with the plurality of pieces 115, 120 enables telescopic adjustment of the pieces 115, 120 on the splicing plug 125. This structural relationship and adjustability provides a means for accommodating the shower rod 15 and holding devices 20 in showers 30 of a variety of lengths 65. In a particular embodiment, length portions 130 and depth portions 135, together, are a middle portion of curtain rod 15. Additionally, length portions 130 define a longitudinal axis 130*a*. As shown in FIGS. 2 and 3, a transverse axis is shown as the z-axis and the longitudinal axis 130*a* is substantially parallel to the x-axis on back wall 25. Also in various invention embodiments, length portions 135 and death portions 130 together generally define three sides of a polygonal area.

Figure 4:
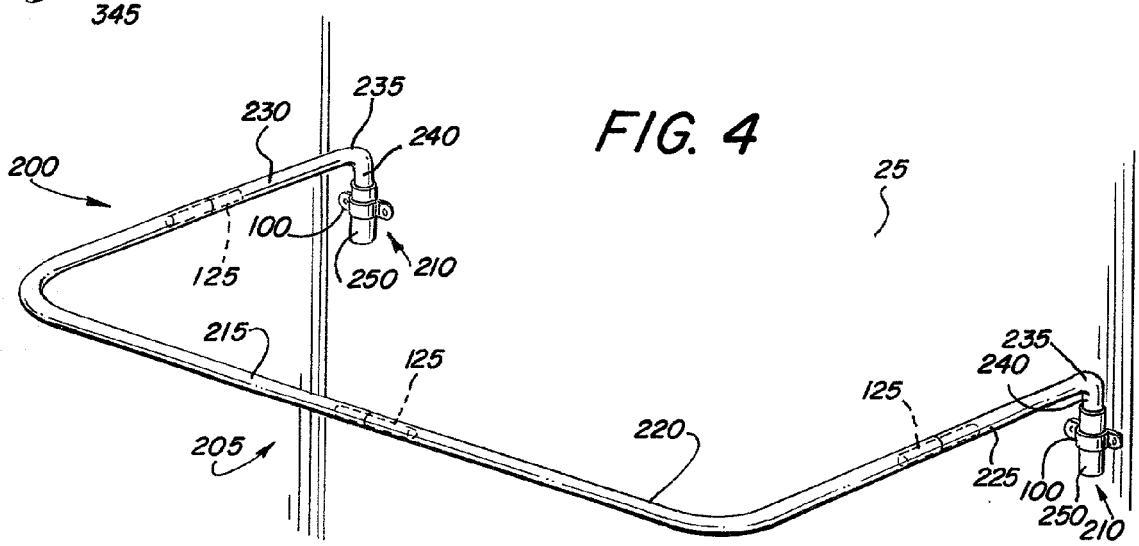
FIG. 4 is a perspective view of an second embodiment.

An alternative embodiment 200 shown in FIG. 4 is similar to the embodiment of FIGS. 1-3 in that the rod 205 and holding devices 210 are configured for mounting on the back wall 25 of the shower 30. A further similarity is that the shower curtain rod 205 is provided by a plurality of pieces 215, 220, 225, 230, each connected to another by a splicing plug 125. First and second pieces 215, 220 are substantially similar to the plurality of pieces 115, 120 of the embodiment of FIGS. 1–3. Third and fourth pieces 225, 230 are identical to each other and comprise respective elbows 235 and distal ends 240. The distal ends 240 are inserted into respective holding devices 210, which have integral mounting and receiving portions 250. That is, the simple vertical tubular portions 250, each receive the respective distal end 240 and are also mounted to the back wall 25 by the clamps 100 as shown in FIG. 4.

Figure 5:
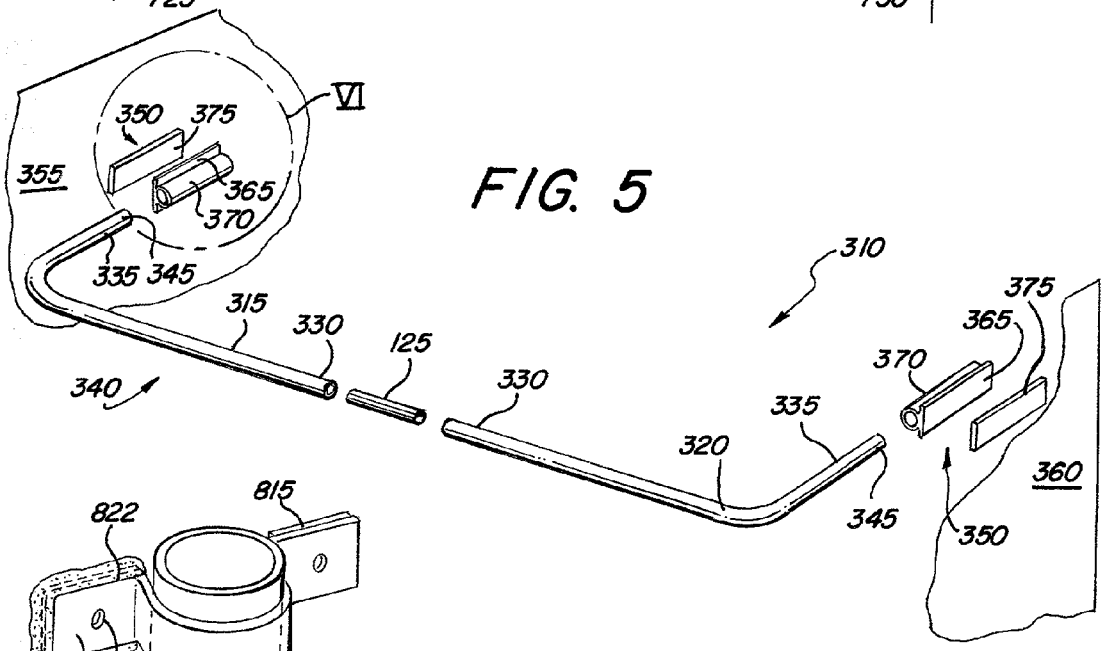
FIG. 5 is a perspective view of a third embodiment.

A further alternative embodiment 310 is shown in FIG. 5. This embodiment is similar to the embodiments of FIGS. 2 and 4 in that it comprises a plurality of pieces 315, 320 that are substantially similar to each other. Each of the pieces 315, 320 comprises a length portion 330 and a depth portion 335. The pieces 315, 320 are connected together by splicing plug 125 to form the overall shower curtain rod 340 with opposite distal ends 345. The embodiment 310 of FIG. 5 is different from the embodiments of FIGS. 1–4 in that the shower curtain rod 340 and holding devices 350 are configured for mounting on end walls 355, 360. As such, the depth portions 335 need not be as long as corresponding portions in the embodiments that mount to the back wall 25. As shown in FIG. 5, the holding devices 350 include a flat mounting portion 365 and a cylindrical receiving portion 370. In this embodiment, the holding devices also include a spacer element 375. The mounting portion and spacer element 375 can be connected to each other and to the wall by any adhesive or attachment means.

Figure 6:
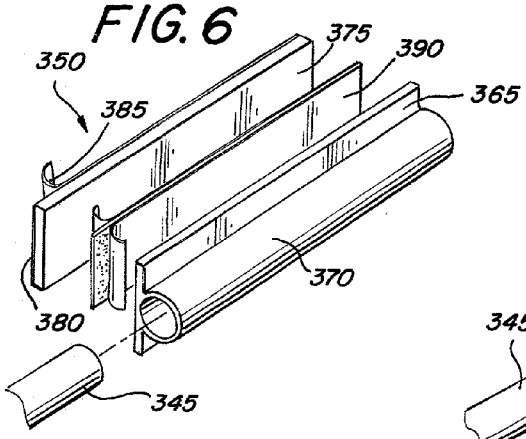
FIG. 6 is an exploded perspective view of region VI of FIG. 5 and including details of a means for accommodating the rod and holding device in a shower.
Figure 7:
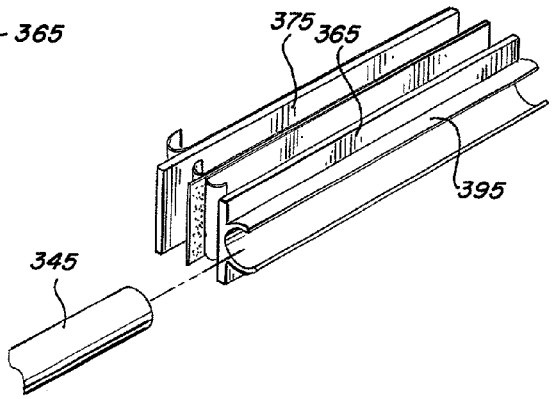
FIG. 7 is an exploded perspective view similar to FIG. 6, but showing the holding device in a still further alternative embodiment.

The holding device 350 can be implemented with the further details illustrated in FIG. 6. That is, the spacer element 375 can be mounted to a wall 355 by a sticky backing 380 normally covered by protective paper 385 prior to use. The mounting portion 365 can be adhered to the spacer element 375 by a double-sided tape 390, for example. FIG. 7 shows a holding device embodiment substantially similar to the embodiment of FIG. 6 except that the receiving portion 395 replaces the receiving portion 370. The receiving portion 395 is in the form of a partial cylinder and provides the added advantage of enabling the distal ends 345 to be snapped in radially in addition to axial insertion thereof.

Figure 8:
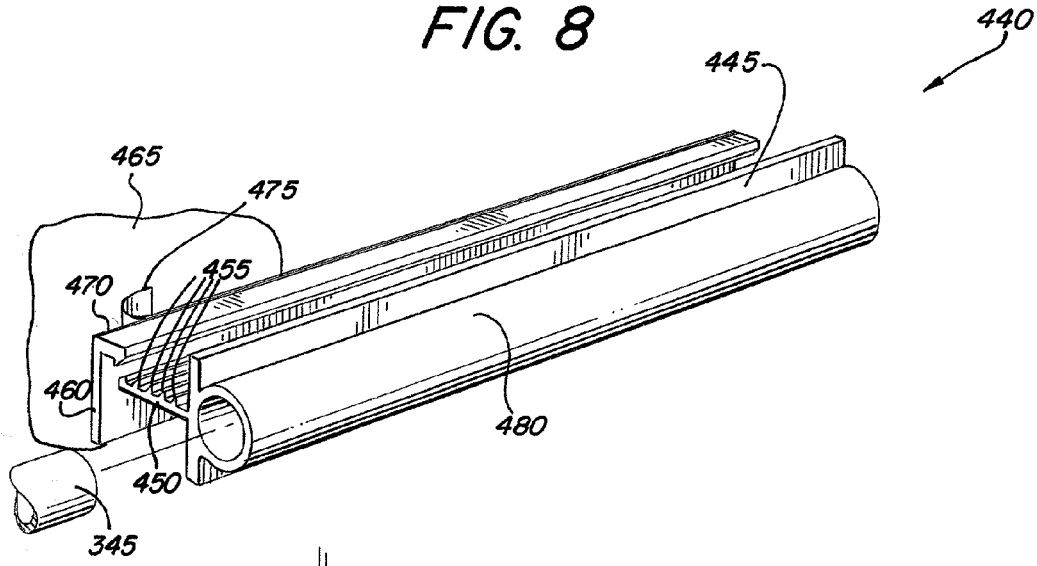
FIG. 8 is an exploded perspective view similar to FIG. 6, but showing the holding device and means for accommodating in a still further alternative embodiment.

FIG. 8 shows a further alternative holding device embodiment in the form of holding device 440. In this embodiment a flat flange 445, otherwise similar to the mounting portion 365 shown in FIGS. 5–7, has a fin 450 protruding substantially perpendicularly to the flange 445. The fin 450 has ribs 455 protruding normally from the fin 450. The fin 450 and ribs 455 interact with structure on a separable mounting member 460 to provide an adjustable thickness in the length direction of the overall holding device 440. In this embodiment, at least the fin 450 of the holding device 440 can comprise a flexible thermoplastic material so that an excess portion of the fin 450 can be trimmed once the needed fin length has been determined. The structure providing for an adjustable thickness in the length direction is also a means for accommodating the shower curtain rod and holding device in showers of a variety of lengths. The separable mounting member 460 is preferably mounted to an end wall 465 by an adhesive backing 470 that is covered by a protective sheet 475 prior to use. As in the previously described embodiments of FIGS. 5–7, a distal end of 345 is inserted into the receiving portion 480 in the assembled and installed configurations of this embodiment.

Figure 9:
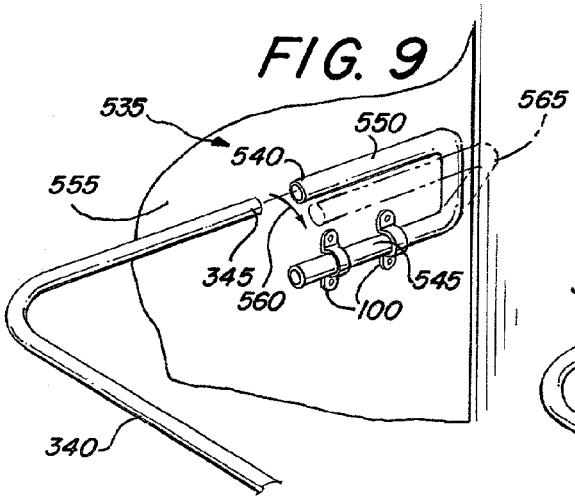
FIGS. 9 and 10 are perspective views of still further embodiments of holding devices incorporating means for accommodating the shower rod in showers of a variety of lengths.
Figure 10:
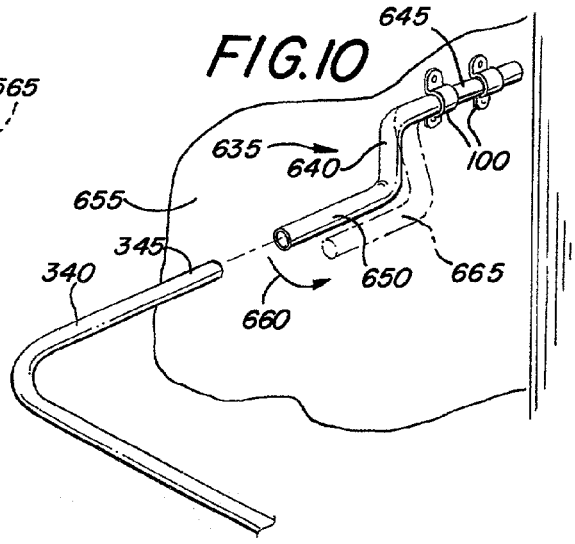

FIGS. 9 and 10 have further alternative embodiments of holding devices 535, 635. In FIG. 8, the holding device comprises a U-shaped member 540. A first leg of the U-shaped member 540 forms a mounting portion 545. A second leg of the U-shaped member 540 forms a receiving portion 550. The mounting portion 545 is mounted on an end wall 555 of a shower by brackets 100. The receiving portion 550 is rotated, for example, in the direction of arrow 560 to a position 565 in order to be in alignment with and receive the distal end 345 of the shower curtain rod 340. This rotation, alignment, and insertion takes up a gap between the rod 340 and the wall 555. Alternatively stated, it provides for an adjustment in overall length of the apparatus and provides a means for accommodating the shower rod 340 and the holding device 535 in showers of a variety of lengths. The holding device 535 can be similarly used at both ends of the shower curtain rod 340.

The holding device 635 of FIG. 10 has a slow "S" shape or double elbow configuration 640. A first leg of the double elbow configuration 640 forms a mounting portion 645. A second leg of the double elbow configuration 640 forms a receiving portion 650. The mounting portion 645 is mounted on an end wall 655 of a shower by brackets 100. The receiving portion 650 is rotated, for example, in the direction of arrow 660 to a position 665 in order to be aligned with and receive the distal end 345 of the shower curtain rod 340. This rotation, alignment, and insertion takes up a gap between the rod 340 and the wall 655. Alternatively stated, it provides an adjustment in an overall length of the apparatus and provides a means for accommodating the shower rod 340 and holding device 635 in showers of a variety of lengths. The holding device 635 can be similarly used at both ends of the shower curtain rod 340.

Figure 11:
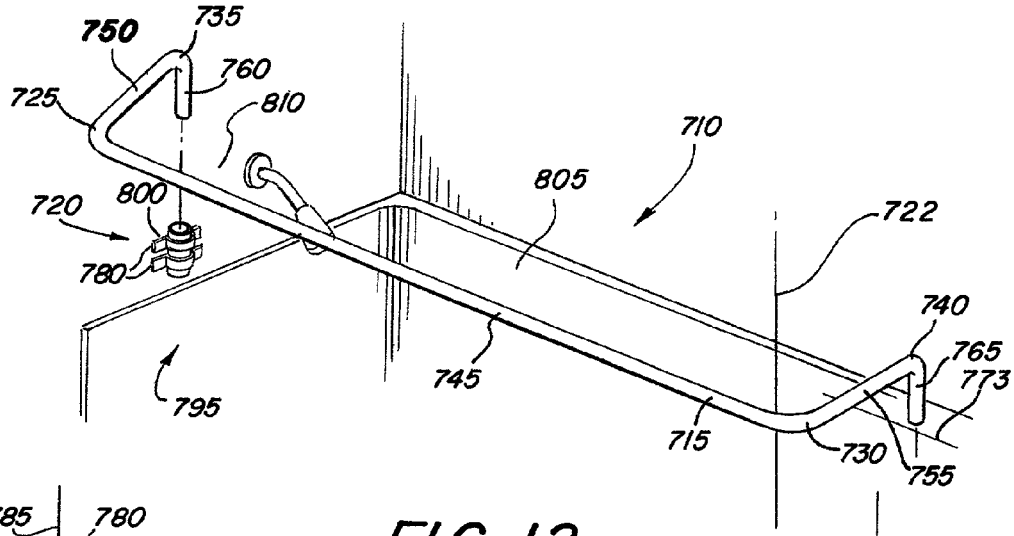
FIG. 11 is an exploded perspective view of a fourth embodiment.
Figure 12:
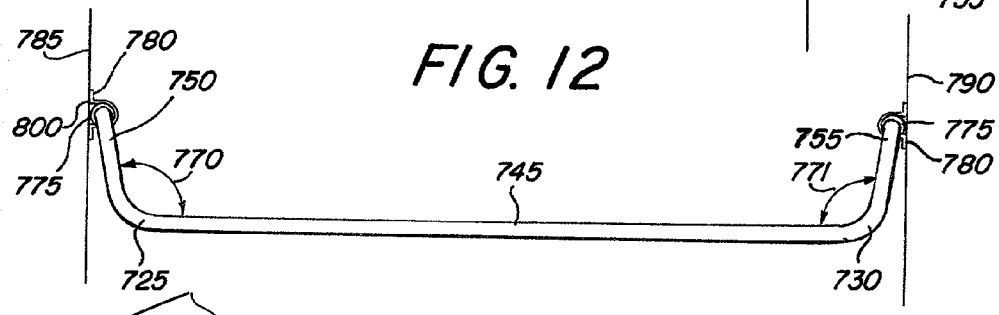
FIG. 12 is a top plan view of the embodiment of FIG. 11.

A still further alternative embodiment 710 of a shower curtain rod and holding device is provided in which a shower curtain rod 715 and holding device 720 are shown in FIG. 11. The shower curtain rod 715 is formed as one-piece having a plurality of bends 725, 730, 735, 740. A first lengthwise portion 745 comprises a generally straight bar that is connected by first and second bends 725, 730 to respective first and second depth portions 750, 755. As shown in FIG. 11, the first and second bends 725, 730 are greater than 90 degrees with respect to the lengthwise portion 745. The first and second depth portions 750, 755 are connected to distal ends 760, 765 by respective third and fourth bends 735 740. The first and second bends 725, 730 are mirror images of each other and form obtuse angles 770, 771 between the lengthwise portion 745 and respective depth portions 750, 755 as shown in the top plan view of FIG. 12. The bends 725, 730 are formed about respective vertical axes of radial curvature as shown, for example, at 772. The bends 735, 740 are formed about horizontal axes of curvature as shown, for example, at 773. It can be appreciated that the axes of curvature 722 and 773 are perpendicular to each other. The bends 735, 740 direct the distal ends 760, 765 so that they travel on a vertical axis perpendicular from the first and second depth portions 750, 755. This causes the receiving member 775 to receive the distal ends 760, 765 of the shower rod 715 vertically and in parallel with the vertical axis 722. As shown in FIG. 11, the lengthwise portion 745, depth portions 750, 755 and distal ends 760, 765 are integral and require no assembly in obtaining the desired rod assembly.

The holding device 720 is similar to the holding device 210 shown in FIG. 4 in that the combination mounting and receiving member 775 is configured to receive distal ends 760, 765 in a vertical direction. However, mounting brackets 780 in this embodiment mount the holding device 720 at ends 785, 790 of a shower 795. As can be appreciated, a point of mounting 800 may be located on a preformed shower shell wall 805 or on a wall 810 above the shower shell 805. The material of the walls 805, 810 may be of any type. Most commonly, the materials of the shell 805 and wall 810 will comprise drywall, ceramic tile, marble, wallpaper, paint, plastic, fiberglass, or combinations thereof. A wide variety of fastening means is therefore provided for mounting the holding devices 720 in the shower 795 or on the wall 810.

Figure 13:
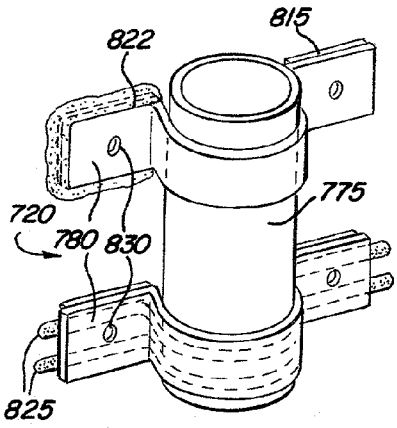
FIG. 13 is a perspective view of the holding device of the embodiment of FIG. 11.

The holding device 720 is mounted by one or more mounting means as illustrated in FIG. 13. Preferably, a double sided tape 815 adheres the brackets 780 to the wall 810. Silicone or another sealing, bonding caulk is used to form a bead 820 along edges 822 of the brackets 780. The bead 820 is beneficial in combination with double sided tape 815 since the bead 820 seals the double sided tape 815 against exposure to moisture. A plurality of horizontally disposed beads 825 similarly formed of silicone or another sealing, bonding caulk provide a mounting means for mounting the combination mounting and receiving portion 775 to the brackets 780 and the brackets 780 to the wall 810. Apertures 830 are further provided for mounting by means of screws or the like.

Figure 14:
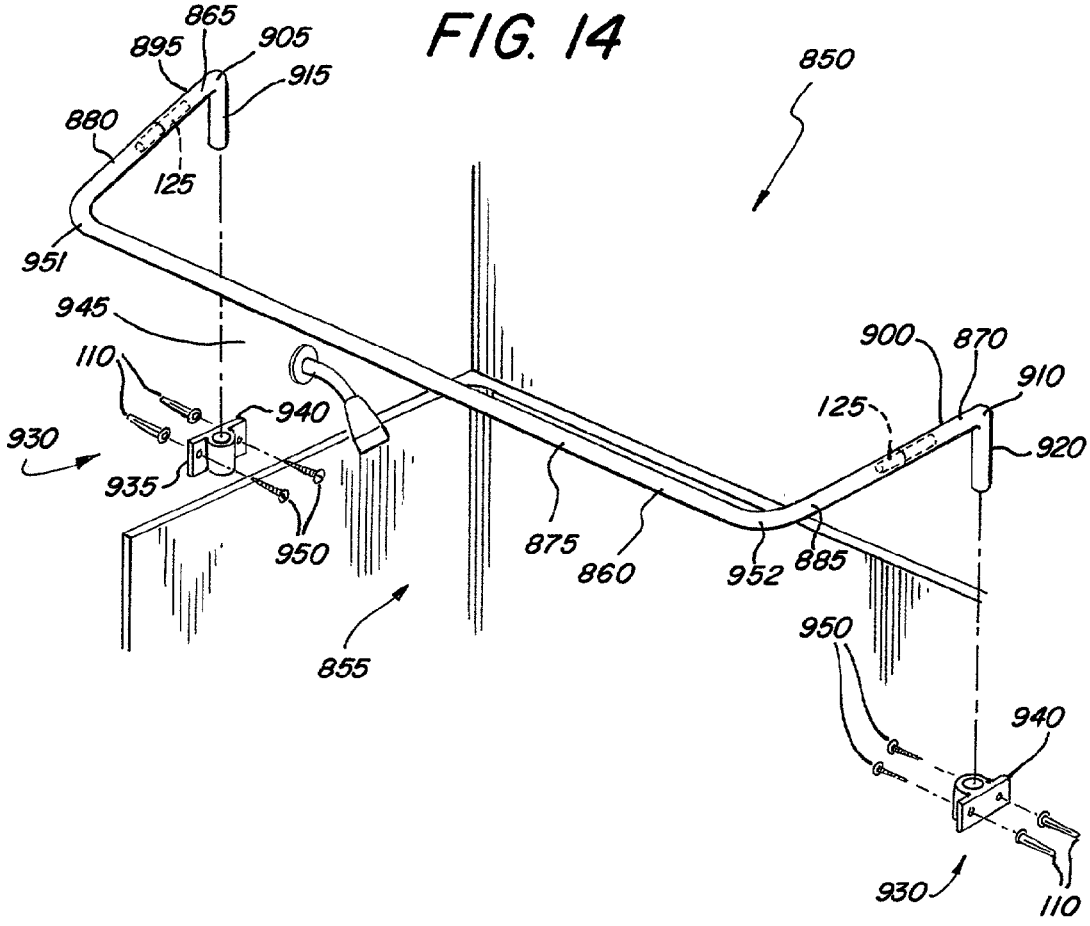
FIG. 14 is a partially exploded perspective view of a fifth and preferred embodiment.
Figure 16:
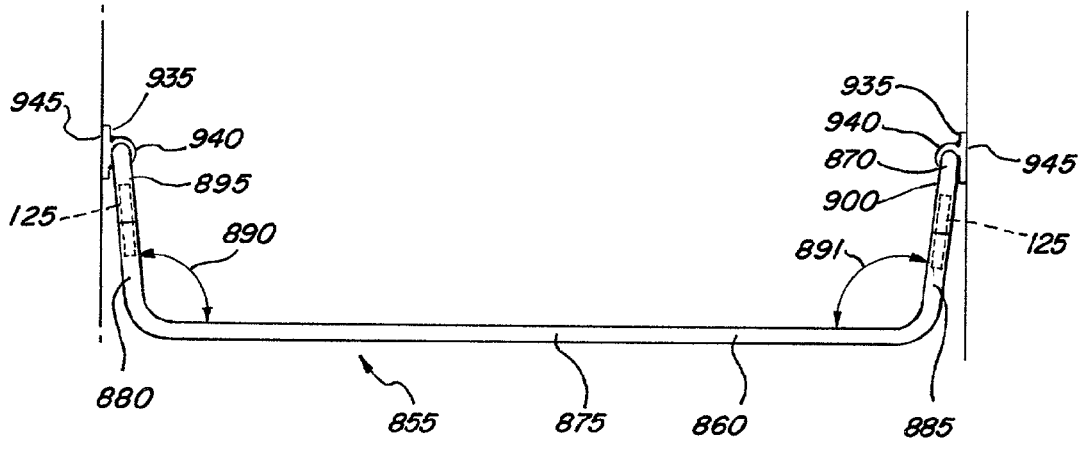
FIG. 16 is a top plan view of the preferred embodiment of FIG. 14 with the shower or curtain rod mounted between the two end walls of a shower.
Figure 15:
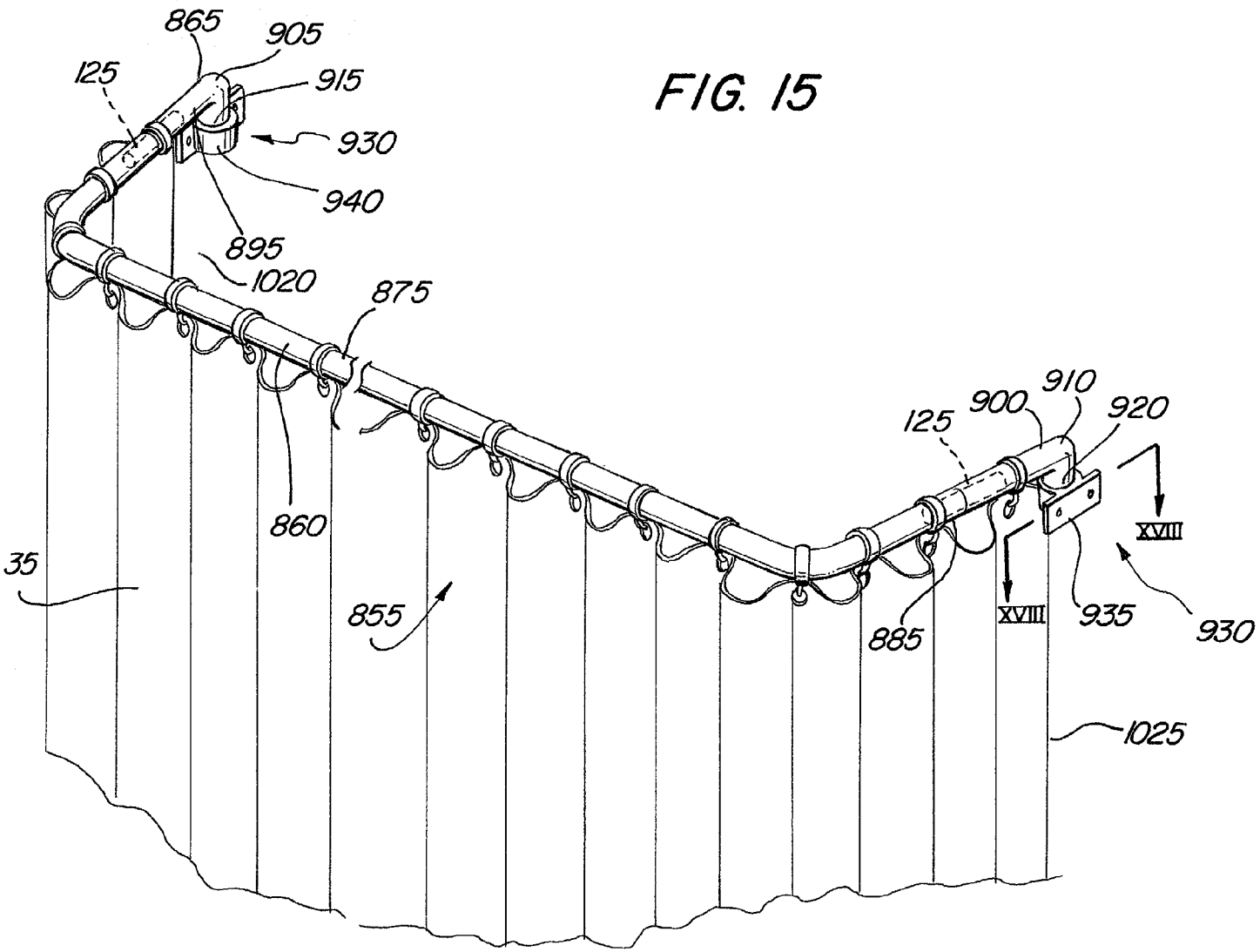
FIG. 15 is a perspective view of the preferred embodiment of FIG. 14 with the shower rod supporting a shower curtain and mounted in the holding devices.

In the preferred embodiment 850, the shower curtain rod 855 is similar to the shower curtain rod 715. However, the shower curtain rod 850 is formed of a plurality of pieces 860, 865, 870 as shown in FIGS. 14–16. The first piece 860 forms a first generally straight, lengthwise portion 875 with two forward depth portions 880, 885 forming obtuse angles 890, 891 at opposite ends of the lengthwise portion 875. The forward depth portions 880, 885 are preferably mirror images of each other. The forward depth portions 880, 885 are connected by respective splicing plugs 125 to respective rearward depth portions 895, 900 of second and third pieces 865, 870. Each of the second and third pieces 865, 870 has a ninety-degree bend 905, 910 connecting the rearward depth portions 895, 900 to respective distal ends 915, 920. The ninety-degree bends 905, 910 direct the depth portions 895, 900 in a vertical direction so that the rod 850 is perpendicular to the depth portions 880, 885. The holding devices 930 receive the rod 850 directly, as opposed to an extension of the rod 850, on a vertical axis.

Holding devices 930 are preferably formed of a single piece and have respective mounting portions 935 and receiving portions 940. The holding devices 930 are otherwise substantially analogous to the holding devices 720. That is, the holding devices 930 are shaped similarly, are adapted to be mounted at similar mounting points 945, and are adapted to receive respective distal ends 915, 920 in a substantially vertical direction similar to the holding devices 720. The holding devices 930 can be mounted to walls comprising the same materials set forth in the description of the embodiment of FIGS. 11–13, and are attached by the same attachment means as were disclosed for attaching the holding device 720. When the material at the mounting points 945 comprises drywall, screws 950 are preferably of the plastic, chamfered, self-tapping type. Alternatively, the screws 950 can be of any non-corrosive material including stainless steel, brass, or a zinc coating, and can be used in conjunction with corresponding expansion receivers 110. The preferred embodiment 850 enables securing the holding device by a plurality of mounting means including the screws 950, double sided tape 815, silicon type adhesive 825, sealant 820, and the lengthwise directed compression force exerted by the resilient bends 951, 952 when released between lengthwise end walls that are narrower than an overall length of the shower rod 855 and holding devices 930 as described above.

Figure 17A:
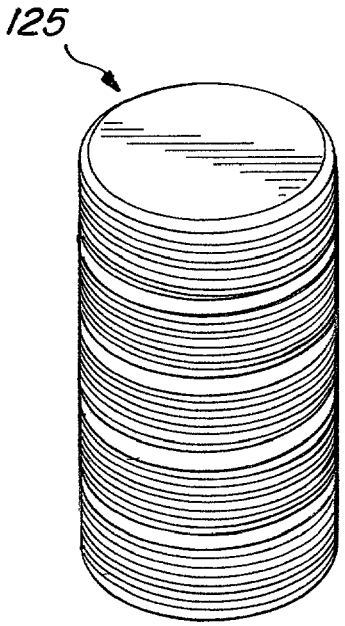
FIG. 17A is a perspective view of a splicing plug in accordance with various embodiments of the invention.
Figure 17B:
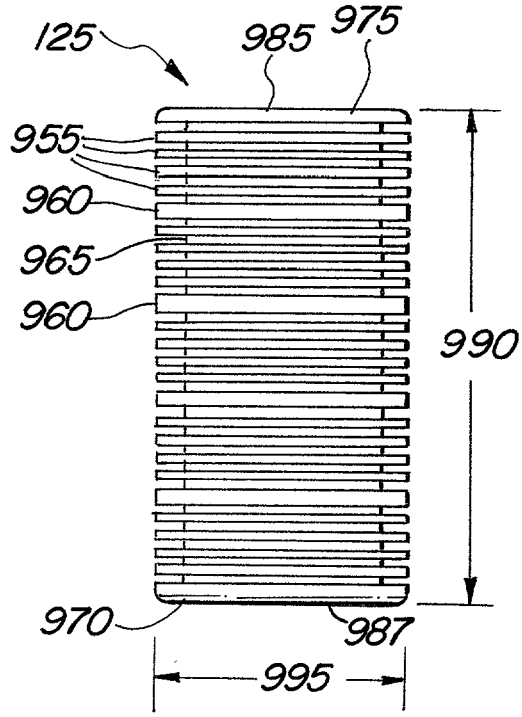
FIG. 17B is a side elevation view of the splicing plug of FIG. 17A.

The splicing plugs 125 are preferably formed of a multitude thin flanges 955 and thick flanges 960 extending radially outward from a plug core 965 as shown in FIGS. 17A and 17B. End flanges 970, 975 are rounded from an outer periphery 980 toward end faces 985, 987 to aid insertion of the splicing plugs 125 in an inner diameter of a rod piece. The flanges 955 and 960 can bend slightly in an axial direction and therefore provide some give during insertion into rod pieces when the rod pieces are being coupled together. On the other hand, the flanges 955, 960 provide relatively high stiffness against radial compression and thereby prevent a weakened bending tendency at the joints between shower rod pieces as would be expected with other plug configurations. The splicing plugs 125 may be of any length, but preferably have a length 990 greater than a diameter 995. The plug 125 for apparatuses in accordance with the instant invention will have a length 990 in a range from 1 to 7 inches. For ¾ inch pipe, the plug 125 preferably has a length 990 of 1.43 inches and a diameter 995 of 0.8 inches.

Figure 18:
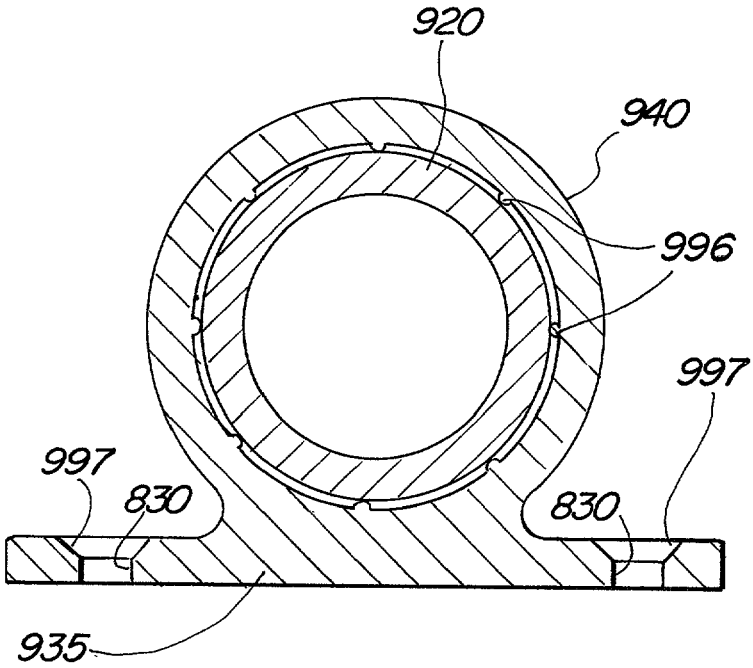
FIG. 18 is a section view taken along lines XVIII—XVIII of FIG. 15.

A sectional view of holding device 930 is shown in FIG. 18. Protrusions 996 extend radially inwardly and engage an outer surface of the distal end 920 of the shower rod 855. The protrusions 996 provide an easier fit during installation of the shower curtain rod on the holding device. The protrusions 996 also help to overcome any out-of-round and tolerancing problems. Apertures 830 have chamfered portions 997 for receiving chamfered screws 950.

In a least expensive and efficiently made form, most or all of the pieces of the apparatus described above are formed of thermoplastic material such as by well known molding methods. As an example and not by way of limitation, the materials can comprise PVC, ABS, nylon, polystyrene, polypropylene, polyethylene, or hybrid plastic materials. The materials may also comprise woods or metals including aluminum. For a more expensive apparatus with added aesthetic appeal, the rod, holding device, and screws can comprise brass, stainless steel, chrome plating, or other brightly finished materials.

Figure 19:
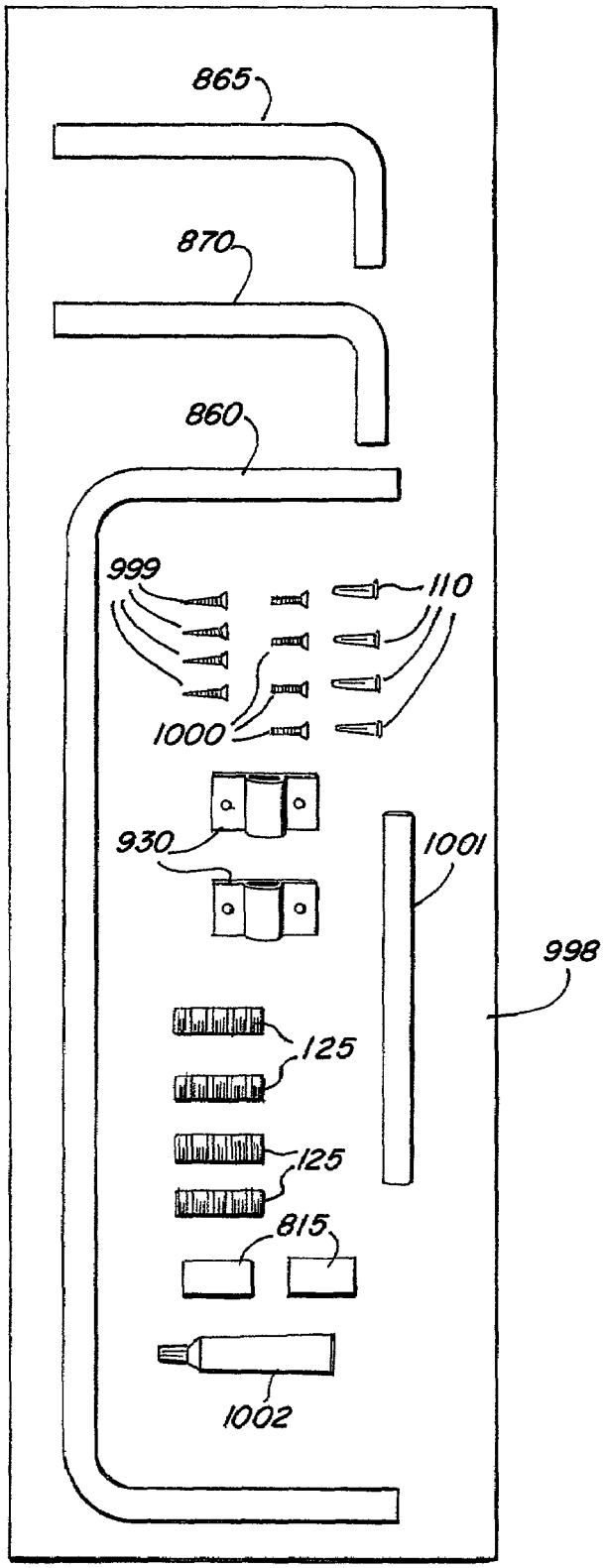
FIG. 19 is an exemplary view of a kit in accordance with the invention.

It is to be understood that components of any of the embodiments described above can be placed together in a package 998 to form a kit as exemplified in FIG. 19. In this way, a plurality of kits can be formed to fit the most common shower sizes and configurations. The components in a given kit may comprise additional pieces to help accommodate a given kit into more than one shower size or configuration. For example, additional splicing plugs 125 may be included so that an installer may cut out and unneeded portion of a length or a depth member and rejoin the remaining pieces in a shortened configuration by splicing. Further by way of example, both self-tapping screws 999 and standard screws 1000 can be included in the package 998. The package 998 of FIG. 19 also shows an extra length of pipe 1001 and a tube of adhesive 1002. All of the other complements in the package 998 are labeled and have been discussed in relation to previously described embodiments. It is to be explicitly understood that the kit and the package 998 forming the kit are purely exemplary. Any one of the embodiments described above or any combination of the embodiments may be combined and packaged as a kit.

While the embodiments described above and shown in the Figures illustrate shower areas of generally polygonal shapes. It is to be explicitly understood that other shapes are considered to be within the spirit and scope of the instant invention. For example, the shower rods described above can be replaced by round, oval, or other curvilinearly shaped configurations. A primary distinguishing feature in accordance with the instant invention is that an area defined by the shower curtain rod is generally offset from the distal ends of the rod. As a practical aspect, the rod will advantageously, generally follow the contour of the walls of the shower in an overlapping configuration for at least approximately one third of the shower area depth.

A method of preventing water from escaping from a shower area comprises disposing a shower curtain 35 on a plurality of sides of the shower area 70 and is enabled by each of the several embodiments set forth above. That is, the method can be accomplished by installing and using an apparatus of any one of the embodiments set forth above. Furthermore, it can be appreciated that depth portions enable the shower curtain 35 to cover at least one-third of the depth 40 of the shower area 70 from a front 45 of the shower area 70. As shown in FIGS. 1–4, the depth portions enable coverage of a full depth of the shower area.

Also in accordance with the method, the mounting points 800, 945, and the depth dimension of the depth portion is selected so that a lower portion 1010 of the curtain 35 hangs in friction contact with an inner front wall 1015 of the tub 80. The friction contact between the shower curtain and the inner wall 1015 stabilize the curtain 35 against inadvertent movement along the shower rod. Thus, once the shower curtain ends 1020, 1025 have been moved rearwardly in a depth direction into a surrounding configuration as shown in FIG. 15, the shower area 70 is secured to prevent water from escaping during showering.

Figure 20:
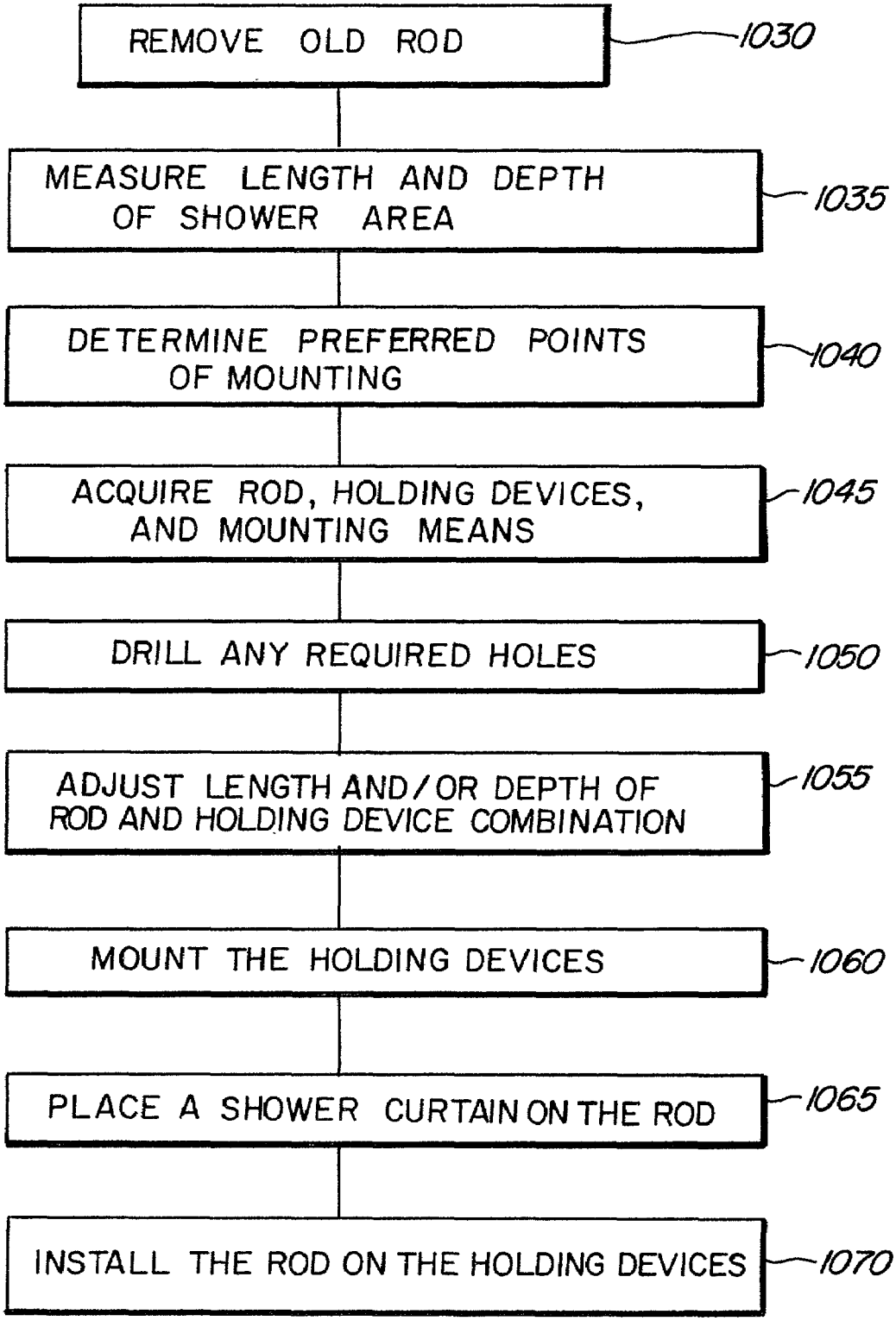
FIG. 20 is a flow diagram depicting the basic steps of a method of installing an apparatus in accordance with the invention.

Some or all of the steps of the method of installing are listed in the flow diagram of FIG. 20. In the case of retrofitting one of the instant apparatuses in a shower that already has a rod, the method of installing includes the step 1030 of removing the old shower curtain rod. Before the step 1045 of acquiring the new rod, holding devices, and mounting means, an installer generally measures the length and depth of the shower area as indicated by block 1035 and selects preferred mounting points for the new holding devices as indicated by block 1040. Then the appropriate rod, holding devices, and mounting means are acquired as indicated at step 1045. Preferably, the components are acquired as a kit of pieces combined in a package that is appropriate for a given shower size and configuration. Some installations require that holes be predrilled in accordance with step 1050. For some shower sizes and configurations, the shower rod length or depth will need to be adjusted as indicated by block 1055. Then the holding devices are mounted as indicated at 1060. Before installing the rod on the holding devices as indicated by block 1070, the shower curtain 35 is placed on the rod in accordance with step 1065.

It can be appreciated that for standard shower sizes and configurations, installation will require only a few minutes. Furthermore, because the holding devices can be mounted before connecting the shower rod to the holding devices, the cumbersome task of holding up a distal end of the shower rod while attaching a proximal end thereof is avoided. In the preferred embodiment, the opposite distal ends 915, 920 of the shower rod are easily slipped into respective receiving portions 940 of the holding devices 930 in a vertical direction and require no further securing.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. The claims are thus to be understood to include what is specifically illustrated and described above, what is conceptionally equivalent, what can be obviously substituted and also what incorporates the essential idea of the invention.

What is claimed is:

1. A shower assembly for preventing water from escaping, comprising:

a first shower wall;

a second shower wall;

a shower curtain rod having:

first and second ends distal from each other, the first and second ends being generally non-collinear with each other and adapted to be mounted in vertical directions; and a middle portion between the first and second ends;

the rod having a length measured along a longitudinal axis and a depth portion measured perpendicular to the longitudinal axis;

wherein the first and second ends, the depth portion and the middle portion are integral with each other;

a first holding device coupled to the first shower wall, the first holding device having a first receiving portion axially aligned with and directly supporting the first end of the rod in a vertical direction, the first receiving portion being perpendicular to the depth portion; and a first mounting portion with a wall engaging surface substantially parallel to the longitudinal axis for mounting the first holding device on a the first shower wall at least partially surrounding a shower; and a second holding device coupled to the second shower wall, the second holding device having:

a second receiving portion axially aligned with and directly supporting the second end of the rod in a vertical direction, the second receiving portion being perpendicular to the depth portion; and a second mounting portion with a wall engaging surface substantially parallel to the longitudinal axis for mounting the first holding device on the second shower wall.

2. The shower assembly of claim 1, wherein each of the receiving portions has an alignment axis generally transverse to the longitudinal axis.

3. The shower assembly of claim 1, further comprising: each of the receiving portions having a an alignment axis generally in a plane defined by the middle portion.

4. A shower assembly for preventing water from escaping, comprising:

a first shower wall;

a second shower wall;

a nonlinear shower curtain rod defining a longitudinal axis having:

first and second ends distal from each other, the first and second ends defining generally non-collinear axes relative to each other;

wherein the first and second ends are inseparable from the shower curtain rod; and a first holding device coupled to the first shower wall, the first holding device having:

a first mounting portion and a first receiving portion, the first receiving portion having a first central axis in a vertical direction and slidingly receiving the first end of the rod directly in a vertical direction; and a second holding device coupled to the second shower wall, the second holding device having:

a second mounting portion and a second receiving portion, the second receiving portion having a second central axis in a vertical direction and slidingly receiving the second end of the rod directly in a vertical direction.

5. The shower assembly of claim 4, the nonlinear rod having:

a lengthwise linear central portion; and depth-wise portions provided by obtuse bends at each end of the central portion, the depth-wise portions each having an additional 90 degree bend terminating in a respective one of the ends of the nonlinear rod.

6. The shower assembly of claim 4, comprising: the non linear rod having a first and a second bend at each respective opposite end; the first bend is less than 90 degrees and interconnects a generally straight central portion to a depth portion; and the second bend is substantially 90 degrees and is at an end of the depth portion opposite the first bend.

7. The shower assembly of claim 6, comprising: the first bend having a first axis of curvature and the second bend having a second axis of curvature perpendicular to the first axis of curvature.

8. The shower assembly of claim 6, wherein the first bends are resilient so that respective depth portions can flex inwardly toward each other to accommodate the rod and holding device between walls of the shower that are closer together than the overall length of the rod and the holding device in their natural unflexed condition.

9. The shower assembly of claim 6, wherein: the depth portions each have a break dividing the depth portions into respective front and rear portions; and respective splicing plugs interconnect the front and rear portions.

10. The shower assembly of claim 9, wherein the splicing plugs comprise flanges.

11. The shower assembly of claim 10, wherein the flanges comprise flanges of a plurality of thicknesses.

12. The shower assembly of claim 9, wherein: the splicing plugs limit relative rotation of the front and rear portions to rotation about central axes of the splicing plugs; and the receiving portion prevents rotation of the rear portions about the central axes of the splicing plugs.

13. The shower assembly of claim 4, wherein the non-collinear axes of the first and second ends of the nonlinear rod are parallel to each other.

* * * * *